United States Patent [19]

Parma

[11] Patent Number: 4,574,603

[45] Date of Patent: Mar. 11, 1986

[54] DIAL-TYPE COMBINATION LOCK

[75] Inventor: Giancarlo Parma, Lainate, Italy

[73] Assignee: SERCAS s.r.l., Polverigi, Italy

[21] Appl. No.: 631,777

[22] Filed: Jul. 17, 1984

[30] Foreign Application Priority Data

Jul. 29, 1983 [IT] Italy ..... 22360 A/83

[51] Int. Cl.[4] ..... E05B 37/08

[52] U.S. Cl. ..... 70/303 A; 70/316; 70/321; 70/323

[58] Field of Search ..... 70/302, 303 R, 303 A, 70/315, 316, 317, 318, 319, 321, 322, 323, 326, 327, 328, 329

[56] References Cited

U.S. PATENT DOCUMENTS

| | | | |
|---|---|---|---|
| 3,386,275 | 6/1968 | Potzick | 70/316 |
| 3,410,121 | 11/1968 | Morin | 70/316 |
| 3,702,551 | 11/1972 | Blizard | 70/303 A |
| 4,142,388 | 3/1979 | Phillips | 70/316 |

OTHER PUBLICATIONS

"Combination Lock Glossary", Pub. 1956, Sargent & Greenleaf, Inc.

*Primary Examiner*—Robert L. Wolfe

*Attorney, Agent, or Firm*—Browdy and Neimark

[57] ABSTRACT

The invention relates to the technical field of combination locks, and in particular to a combination lock of the type having a plurality of combination dials which, once angularly positioned, enable a manually turnable driver element to cause translation of a bolt element by a means of a stud engageable with said combination dials.

Provision is made for said stud to be rotatable coaxially with said dials and oscillably movable radially thereto. Further, said dials are defined by a ring which is split by a cut and clamped, by elastic deformation, onto a smooth surface of a hub.

11 Claims, 13 Drawing Figures

DIAL-TYPE COMBINATION LOCK

BACKGROUND OF THE INVENTION

This invention relates to a dial-type combination lock.

As is known, wide acceptance have gained, in the field of safety locks, combination locks which comprise, as the basic components thereof, combination dials or disks formed with edge seats or "gates", a driver element operable from the outside, e.g through an indexed knob, and arranged to act on said dials and provided with a drive seat located at its periphery, and a stud mounted on a bolt element of the lock. Said stud is adapted to engage with all of said seats when the latter are brought into mutual alignment, that is, when the driver element, operatively connected to said dials, is turned from the outside into a set combination.

It is current practice in the art to make the stud with a barb-like shape having a hooked end which can be inserted into the drive seat of the driver element and the opposite end articulated, through a swivel connection, on said bolt element. This prior stud configuration is further provided with a lug adapted for insertion into said edge seats on the combination dials. When the latter have their respective edge seats aligned to one another, said lug moves into the seats and the stud is allowed to rotate about said swivel connection and engage with the driver element through its hooked end. Thus, the driver element is made operatively rigid with the bolt element and can move it to open a door or the like.

The combination dials are currently formed by rings engaging, by means of specially provided internal grippers, with peripherally toothed hubs. The rings are formed peripherally with the cited "gates" or edge seats, the hubs having guide projections adapted to operatively connect each combination dial to adjacent dials and said driver element. The angular offset of the edge seats from the guide projections determines the combination numbers to be set in order to align said edge seats and enable said stud to "hook up" said driver element to connect it to said bolt element.

Prior locks, as outlined above, have been used for years and always developed some faults, which could not be remedied heretofore.

The first of such faults in the following. Each thrust exerted on the bolt element reflects on the stud, and the stud, when loaded, is frictionally jammed against the adjacent elements. Thus, the lock will not open with the bolt element thus loaded and fail to directly entrain the closure elements of a door or the like whereto it is connected, since this action would in all cases involve application of a load. This situation is aggravated by another fault of such prior locks: the travel distance of the bolt element is invariably quite limited, and hence, only suitable for "locking" and not direct "dragging" locks.

It should be further noted that the barbed stud enters said edge seats or "gates" along a path on an arc of a circle with its pivot point on said swivel connection. This path form requires that considerable play be allowed betfween the stud and edge seats, and this play permits the lock to be opened even with different combinations from the set one, so long as they happen to be proximate to it.

This inaccuracy adds to the particularly serious one originating from that, in the combination dials, the rings are made rigid with the respective hubs through tooth formations. The net result is that the change in the angular positions, between hubs and rings, cannot be set continuously but made dependent on the tooth pitch.

Finally, it is well known in the art that if in such prior locks the drive seat happens to be in the aligned position with the combination dial edge seats immediately after the last combination number has been dialled—which number is always dialled by rotation in a counterclockwise direction—the lock jams. This because the stud enters said seats when the active thrust portion of said drive seat is a bevelled side: the stud is then urged directly by the combination dials rather than by the driver element. To prevent this occurrence, instructions for use invariably warn of not using for the last combination number a given series of numbers which produce the above-described condition. However, it is not infrequent for the user to make a mistake, and the lock jams up.

SUMMARY OF THE INVENTION

In view of the foregoing situation, it is a primary object of this invention to provide a novel dial-type of combination lock which can obviate in a substantial manner such prior deficiencies, and in particular, operate reliably and accurately.

This object is substantially achieved by a dial-type combination lock comprising, on a stationary supporting frame, a bolt element connected to external closure elements controlled by the lock itself, a driver element manually turnable from the outside and having a drive seat at one edge thereof, a plurality of rotatable coaxial combination dials operatively connected together and to said driver element, as well as having edge seats adapted to be moved into mutual alignment relationship, and a stud engageable with said seats and adapted to transmit the movements of said driver element to said bolt element, said stud being movable from a released position to a working position whereat said stud engages with all of said seats, characterized in that said stud includes a base portion extending parallel to said dials and arranged to be rotatable coaxially therewith, and hooking members adapted for insertion in said seats and projecting from said base portion in a transverse direction to the plane of lay thereof, and in that guide elements are provided in said stationary frame operative to impart to said hooking members linear oscillations in a radial direction to said dials as said stud is moved from said released position into said working position.

BRIEF DESCRIPTION OF THE DRAWINGS

Further features and advantages of the invention will be more clearly understood from the following detailed description of a preferred embodiment of a dial-type combination lock, to be taken in conjunction with the accompanying illustrative drawings, where.

DESCRIPTION OF THE PREFERRED EMBODIMENT

Figures 1, 3, 4:
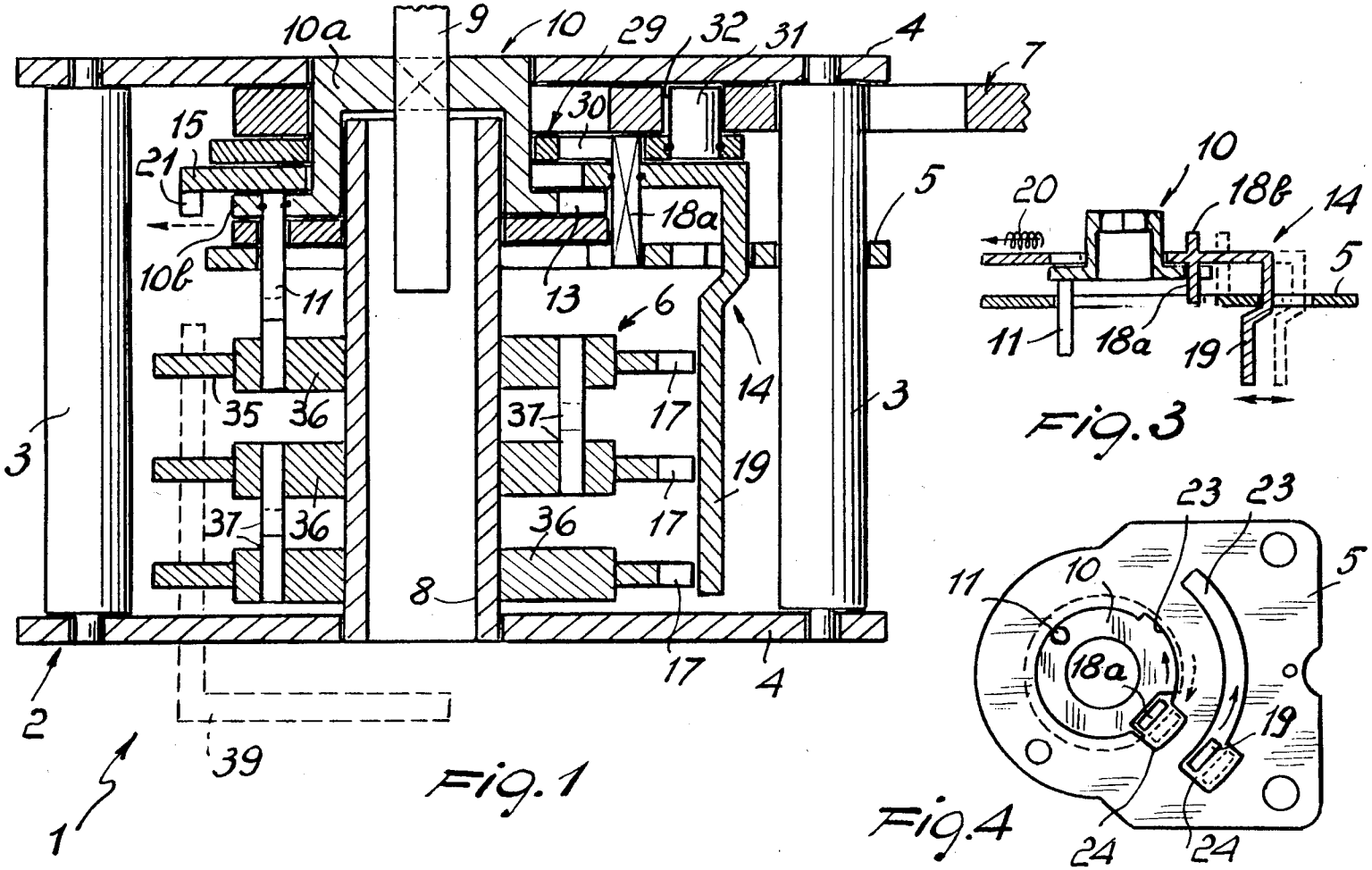
FIG. 1 is a general sectional view showing this combination lock in a merely diagramatic way.
FIGS. 3 and 4 are respectively a side sectional view and front view of some of the elements shown in FIG. 2, in their assembled condition.

Making reference to the drawing views, a combination lock according to this invention is generally designated with the reference numeral 1 in FIG. 1, where it is shown in schematic form. It comprises, as illustrated, a supporting frame 2 defined by a number of spacers or posts 3, a pair of end plates 4 which may be part of a door or the like to be locked by means of the lock 1, and a fixed plate 5 which separates that portion of the lock 1 where the combination dials or disks 6 are mounted from that portion of the lock which carries control members for the combination dials 6 and a bolt element 7.

Located centrally to the lock 1, is a tube 8 lying coaxially with the combination dials 6 and serving the function of a central support for the various lock members. Inserted into the tube 8 is a control rod 9 connected to an indexed knob or knob with pointer, while on the exterior of the tube 8, there engages rotatably a driver element 10 which is box fitted to the control rod 9 and operates the lock as a whole. In particular, the driver element 10 is at all times keyed, through a drive pin 11, to the combination dials 6, which it drives rotatively. More detailedly, the driver element 10 has the contour shown in FIG. 2 and includes a hollow cylindrical portion 10*a* and ring-like portion 10*b*. The latter has on its exterior a shaped annular rim 12 defined substantially by a cylindrical band having a drive seat 13 formed therein the edges whereof are, the one bevelled with a sloping surface and the other straight stepped. The straight edge is the active or thrust edge as the driver element 10 is rotated in a clockwise direction by the control rod 9. Coaxially with the cylindrical portion 10*a* of the driver element 10, on the exterior thereof, there is mounted a stud 14 which comprises a sheet-like base portion 15, and members for engagement with the drive seat 13 and edge seats 17 formed in the combination dials 6.

The base portion 15 extends parallel to the combination dials 6, and is formed at its center with a guide hole 15*a* adapted to permit the stud 14 to oscillate linearly and parallely to the base portion 15.

The cited engagement, or hooking, members include a first drive lug 18*a* projecting perpendicularly from the base portion 15 and adapted for insertion into the drive seat 13, and an interlock rod 19 mainly extending in a parallel direction to the first drive lug 18*a* and being intended for insertion into the edge seats 17, as shows FIG. 1. The distance from the first drive lug 18*a* to the interlock rod 19 is such that, as the first drive lug 18*a* is brought to bear on the shaped annular rim 12, out of the drive seat 13, the interlock rod 19 is very close to, but away from, the outer edges of the combination dials 6.

As brought out in FIGS. 3 and 4, the stud 14 is guided in its movements by guide elements including the cited fixed plate 5, wherethrough the first drive lug 18*a* and interlock rod 19 are passed. In fact, the fixed plate 5 is provided (FIGS. 2 and 4) with guide cuts comprising arc-of-circle cutouts 23 adapted to allow rotation of the cited engagement members, and radial cutouts 24 adapted to allow for linear and radial oscillations of the stud 14 under control by the driver element 10 and against the bias of an elastic means 20.The arc-of-circle cutouts 23 are connected to the ends of the closest radial cutouts 24 to the axis of the combination dials 6 and driver element 10, and can be engaged by the engagement members 18*a* and 19 only when the latter are inserted into the seats 13 and 17.

The elastic means 20 comprises a pin spring engaged with a pin 21 on the stud 14 and stretching as far as detent pins 22 on a connection plate 29, as explained hereinafter. The elastic means 20 may also comprise springs of any types.

Figure 6:
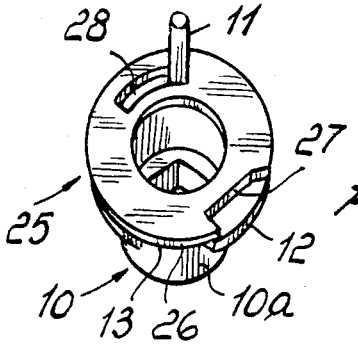
Figure 7:
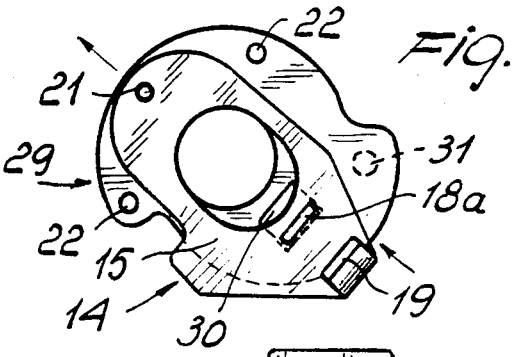
FIGS. 7 and 8 show, in front view, how a stud and connection plate, also shown in FIG. 2, are arranged at two different operation stages and in the assembled condition.
Figure 8:
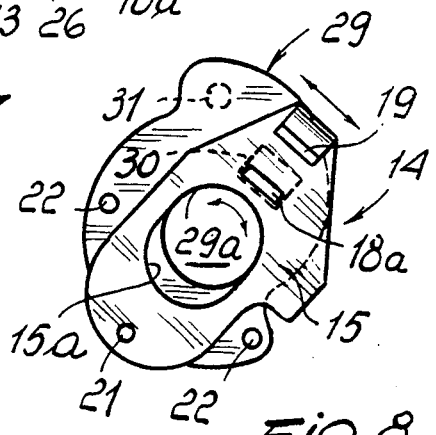

As shown in FIGS. 1,2,5 and 6, a shutter disk 25 is interposed between the driver element 10 and fixed plate 5 which has an auxiliary annular rim 26 formed with the same contour profile as the shaped annular rim 12, and in particular, with an auxiliary drive seat 27 like the drive seat 13. The shutter disk 23 has on its interior an opening 28 extending along an arc of a circle and being penetrated by the pin 11 of the driver element 10. The opening 28 functions, therefore, as a limiting element for the angular oscillations of the shutter disk 25 relatively to the driver element 10, and defines two travel limit positions: a first position whereat the annular rims 26 and 12 and the drive seats 27 and 13 are aligned together, and a second position whereat an angular offset is achieved so as to obstruct the seats 27 and 13, as shown in FIG. 6. The second travel limit position is reached by turning the driver element 10 in a counterclockwise direction relatively to the shutter disk 25, as may be done by an operator manipulating a knob connected to the control rod 9.

Between the stud 14 and bolt element 7, there extends a kinematic train adapted to convert the rotary movement of the stud 14 into linear movements of the bolt element 7. This kinematic train includes a connection plate 29 engaging, at one end, with the stud 14, and at the opposite end, with the bolt element 7, as shown in FIGS. 7 to 10.

The connection plate 29 is mounted pivotally on the hollow cylindrical portion 10*a* of the driver element 10, through a center hole 29*a*, and is connected to the stud 14 through a slot 30 extending in a radial direction to the center hole 29*a* and being adapted to receive a second drive lug 18*b* which results from direct extension of the first drive lug 18*a*. The connection plate 29 engages, at the opposite end, with the bolt element 7 by means of a pin 31 rigid with and standing out from the plate itself for insertion into a groove 32.

This groove 32 is formed on a first portion 33 of the bolt element 7 extending parallel to the combination dials 6 and having an enlarged hole 34 (FIG. 2) wherein the hollow cylindrical portion 10*a* of the drive element 10 is inserted. The groove 32 has one end on the axis of the bolt element 7 and a suitable contour profile to allow constant linear movements of the bolt element 7 as the angular position of the connection plate 29 changes.

An important feature of the lock 1 according to the invention is shown in FIG. 2 and FIGS. 11 to 13.

These views show the construction of combination dials 6 according to the invention. Each of said dials or disks 6 is advantageously defined by an outer ring 35, formed with one of said "gates" or edge seats 17, and by a hub 36 having a guide projection 37 adapted to enable each dial 6 to be keyed to adjacent dials and the drive element 10. The guide projections 37 are known per se and only shown schematically in the drawings. They may all be of the type protruding axially with respect to the dials 6, as shown in FIG. 1, or be part protruding and part dog shaped. The views following FIG. 1 show guide projections 37 in the form of dogs.

Advantageously, the ring 35 is broken by a cut 38 and made from an elastically deformable material, thereby it can be expanded and clamped by elastic deformation onto the hub 36. Furthermore, the engaging surfaces between the ring 35 and hub 36 are prefectly smooth. For inserting or assembling the hub 36 to the interior of the ring 35, as well as for angularly positioning them, a means is provided for expanding the ring 35 which comprises a key 39, indicated in dash lines in FIG. 1 and in perspective view in FIG. 11. The key 39 may be inserted into a notch 40 formed in the ring 35 at the cut 38. The notch 40 extends in a mainly radial direction, is substantially ellypsoidal, and shaped to match the key 39.

Figure 2:
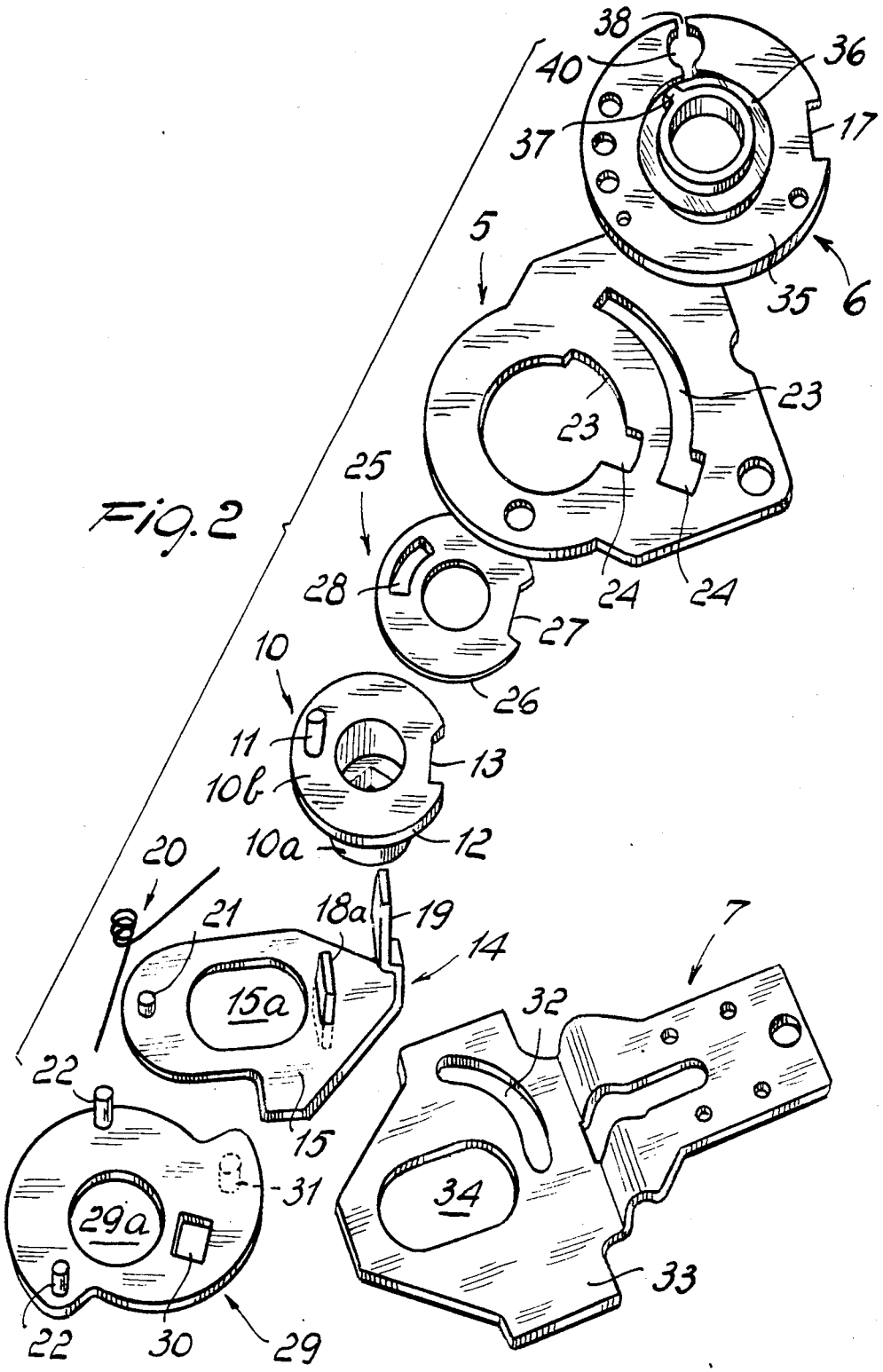
FIG. 2 is an exploded perspective view showing in detail the main elements which make up the lock of this invention.
Figure 5:
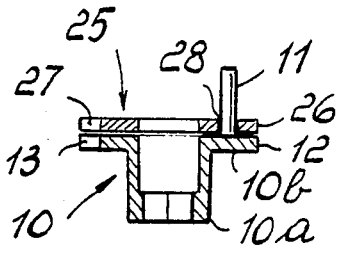
FIGS. 5 and 6 show, in side section and perspective, respectively, a driver element and shutter disk, also shown in FIG. 2.
Figures 11, 12, 13:
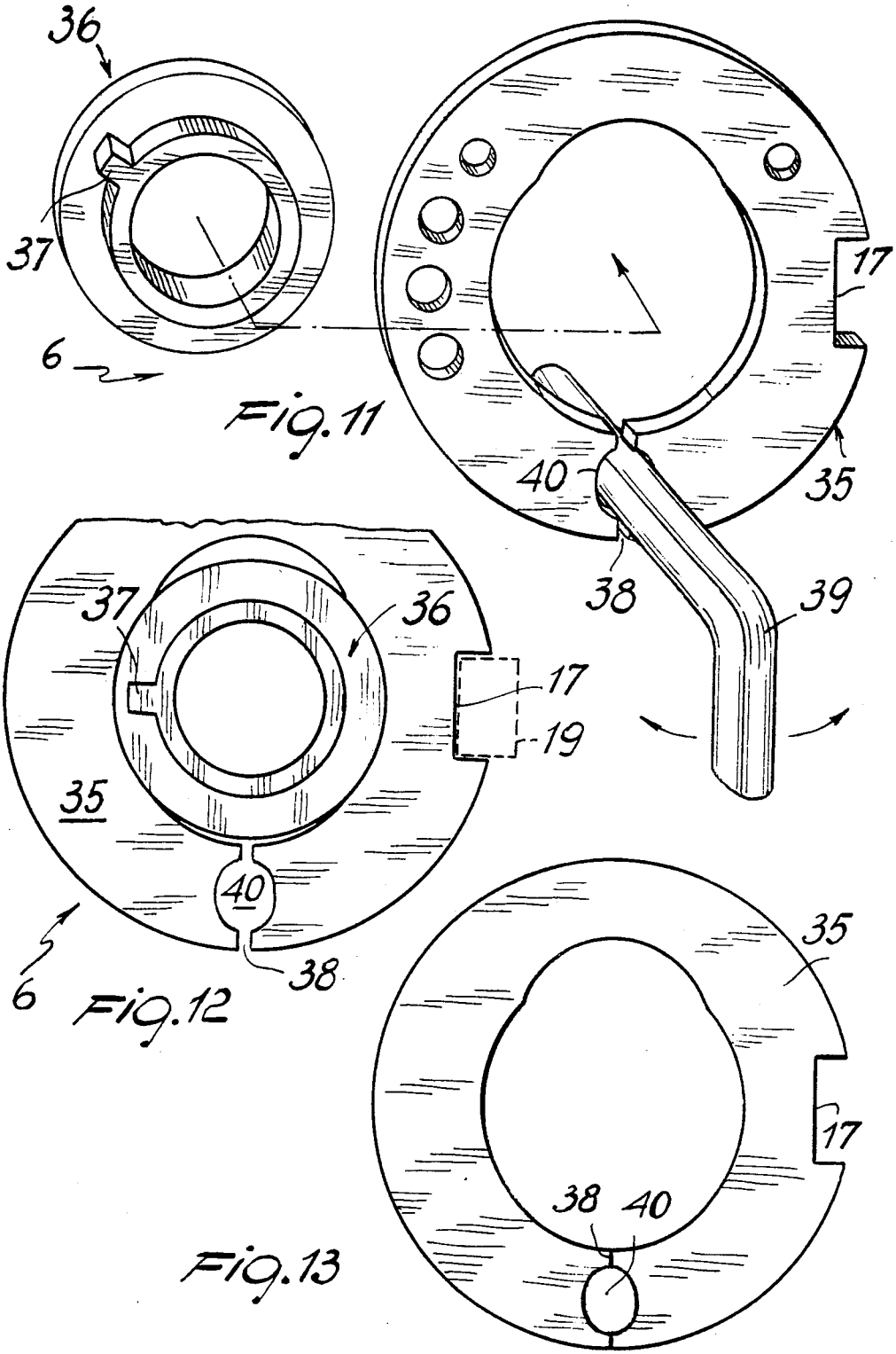
FIG. 11 is an exploded perspective view of a combination dial, also shown in FIG. 2.
FIG. 12 is an enlarged scale front view of one portion of the combination dial of FIG. 2.
FIG. 13 shows separately one ring of the combination dial shown in FIG. 2.

FIGS. 2 and 12 show how the inside portions of the ring 35 located on the one side directly contiguous to the cut 38 and on the other side opposed to said cut are made thinner. Thinning of the ring 35 on the opposed side to the cut 38 favors expansion of the ring 35, whilst thinning at the cut 38 prevents those portions of the ring 35 which cannot apply a clamping action to the hub from interfering with the hub 36. In fact, the portion of the ring 35 adjoining the cut 38 clamps onto the hub 36 with movements directed tangentially to the hub. Thus, it is of poor effectiveness from the clamping standpoint and may interfere by reducing the useful contact surface area, since the cut 38 may originate burrs partly projecting inwardly of the ring 35.

FIGS. 2 and 11 show also holes formed through the ring 35. These are balancing holes adapted to accommodate the presence of the notch 40, cut 38, and cited thinned portions. The lock 1 may include further elements, not shown because foreign to the subject matter of this invention, such as spacers, connection or antifriction elements, various swing and connection elements for the bolt element 7, and so forth.

The combination lock of this invention operates as follows.

The user should first set a selected combination. This operation is performed by inserting, as shown in FIGS. 1 and 11, the key 39 into the notches 40, as brought into alignment, and turn the key 39 in either direction through 90°. This causes the rings 35 to expand, and accordingly, the hubs 36 to position the guide projections 37 into a different angular position relatively to the edge seats 17. Renewed angular positioning of the guide projections 37 relatively to the edge seats 17 is performed in a manner known per se by dialling a fresh combination. Then, the key 39 is removed to leave the lock in the operating condition under control by the control rod 9 and driver element 10. The latter, on the one side, determines the angular positions of the combination dials 6 through the pin 11 and guide projections 37, and on the other side, causes the bolt element 7 to be moved forward or backward as the combination dials 6 are brought into alignment with their edge seats 17.

In fact, with the edge seats 17 aligned together, the interlock rod 19 engages therein to allow insertion of the first drive lug **18*a* into the drive seat 13, when this is correctly positioned and the driver element 10 turned clockwise, as explained hereinafter. Insertion takes place under the urge from the elastic means 20, and consists of a translation of the whole stud 14, as shown in FIG. 3. Thus, the stud 14 brings its engagement elements into alignment with the arc-of-circle cutouts 23 (FIG. 4**), enabling rotation along the cutouts.

The first drive lug **18*a* provides direct driving between the driver element 10 and connection plate 29, since it extends, on the other side of the stud 14, into the second drive lug 18*b*, which enters the slot 30 in the connection plate 29. This slot 30 allows for the amount of play required for the linear movements of the stud 14, but forces the plate 29 and stud 14 to move angularly together. These angular movements are transmitted, through the pin 31, to the bolt element 7**, which is thus driven to perform a linear movement.

Figure 9:
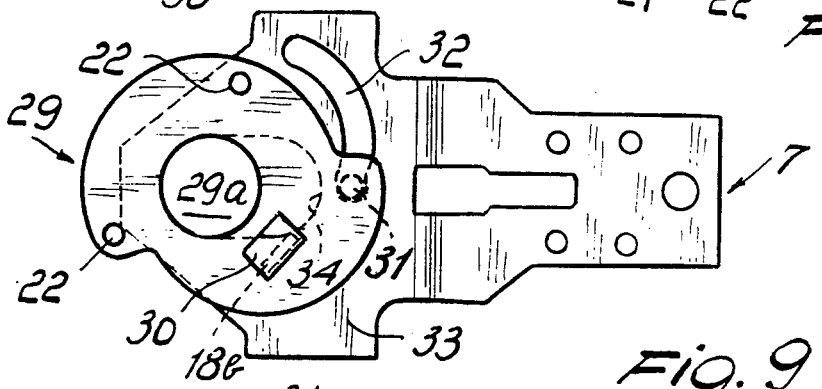
FIGS. 9 and 10 show, in front view, how said connection plate and a bolt element as shown in FIG. 2 interact.
Figure 10:
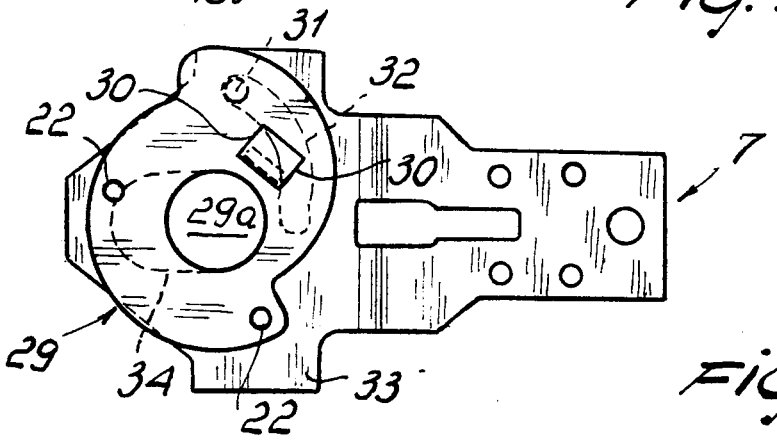

The bolt element 7 is independent of the stud 14 because any force on the bolt element is discharged, through the pin 31, onto the connection plate 29 without affecting the stud 14. The plate would not transfer said forces to the stud 14 because inhibited from translating and because, with the stud 14 oscillated in the radial cuts 24 (FIG. 4), it arranges itself with the pin 31 on the axis of the bolt element 7 (FIG. 9).

As a result of all this, the lock of the invention can also operate properly in the presence of high loads, and accordingly, may be used not only as a locking-action lock but also as a drag-action lock. Various drives may be applied to the bolt element 7 for direct driving of various closure elements, and the kinematic train between the stud 14 and bolt element 7 may be differently sized to increase the travel distance of the bolt element 7 to even a long one.

With the lock of this invention, the stud 14 is inserted into the edge seats 17 with linear movements, thereby the seats may be manufactured without play. This results in higher accuracy of the whole lock. This increased accuracy is further enhanced by the provision of combination dials 6 wherein the rings 35 are engaged with the hubs 36 without resorting to toothed formations, which are inherently inaccurate.

It should be noted that the linear movements of the stud 14 are inhibited by the shutter disk 25 as the driver element 10 is rotated in the counterclockwise direction, as shown in FIG. 6. The shutter disk 25 would close in this situation the drive seat 13 of the driver element 10. Thus, the cited jamming of the lock is prevented.

The provision of the shutter disk 25 enhances the lock reliability also because it discourages manipulation of the lock: with the shutter disk 25 at an angularly offset position relatively to the driver element 10, the interlock rod 19 can under no circumstance touch the combination dials 6.

Finally, it is important to observe that, thanks in particular to the peculiar construction of the combination dials 6, and resulting higher accuracy of the lock, the number of the possible combinations actually corresponds to the theoretical number, as determined by the number of notches in an external control knob and number of the combination dials. With the lock of this invention, moreover, knobs may be provided with a higher number of notches to achieve a very high number of actually feasible combinations.

I claim:

1. A dial-type combination lock comprising, on a stationary supporting frame, a bolt element connected to external closure elements controlled by the lock itself, a driver element manually turnable from the outside and having a drive seat at one edge thereof, a plurality of rotatable coaxial combination dials operatively connected together and to said driver element, as well as having edge seats adapted to be moved into mutual alignment relationship, and a stud engangeable with said seats and adapted to transmit the movements of said driver element to said bolt element, said stud being movable from a released position to a working position whereat said stud engages with all of said seats, characterized in that said stud includes a base portion extending parallel to said dials and arranged to be rotatable coaxially therewith and hooking members adapted for insertion in said seats and projecting from said base portion in a transverse direction to the plane of lay thereof, and in that guide elements are provided in said stationary frame to impart to said hooking members linear oscillations in a radial direction to said dials, as said stud is moved from said released position into said working position.

2. A lock according to claim 1, characterized in that said hooking members of said stud comprise a first drive lug rigid with and substantially perpendicular to said base portion and adapted for insertion into said drive seat, and an interlock rod rigid with said base portion and substantially parallel to said drive lug for insertion into said edge seats in said dials with said seats in mutual alignment relationship.

3. A lock according to claim 1, characterized in that said guide elements comprise fixed detents defined by guide cutouts for said hooking members and formed in a fixed plate on said rigid frame, and an elastic means acting on said stud to oppose the movements thereof and effective to disengage said ho oking members from said seats.

4. A lock according to claim 1, characterized in that said driver element has a ring-like portion provided with a shaped anular rim wherein said drive seat is formed, and in that located adjacently said ring-like portion is a shutter disk having an auxiliary anular rim formed with an identical profile to that of said shaped annular rim and provided with an auxiliary drive seat, said shutter disk being angularly oscillable relatively to said driver element between two travel limit positions, in one of said positions said drive seats being side-by-side and in the other of said positions, as attained by counterclockwise rotation of said drive element through control from the lock outside, said drive seats being angularly offset with respect to one another, thereby defining mutual closure of the drive seats themselves.

5. A lock according to claim 1, characterized in that between said stud and said bolt element there is provided a kinematic train adapted to convert the rotary movement of said stud into linear movements of said bolt element, said kinematic train comprising a connection plate rotatable coaxially with said stud and interposed between said stud and said bolt element and said connection plate being on the one side engaged with said stud via a coupling defined by a second drive lug and corresponding slot extending radially to said dials, and on the other side, engaged with said bolt element through a coupling defined by a pin extending perpendicularly to said connection plate and a groove wherein said pin is inserted.

6. A lock according to claim 5, characterized in that said groove is formed on a first portion of said bolt element adjacent and parallel to said connection plate, in that said groove is shaped to permit constant linear movements of said bolt element as the angular position of said connection plate changes, and in that said groove has one end lying along the line of movement of said bolt element said pin, engaging said end as said stud is oscillated between said released and working positions.

7. A lock according to claim 5, characterized in that said second drive lug is made rigid with said stud and passed therethrough to define, on the remote side from said connection plate, a first drive lug adapted to directly engage with said drive seat on said driver element, said first and second drive lugs thus providing a direct drive connection between said driver element and said connection plate.

8. A dial-type combination lock comprising, on a stationary supporting frame, a bolt element connected to closure elements controlled by the lock itself, a driver element adapted to be turned manually and provided with a drive seat at one edge thereof, a plurality of rotatable and coaxial combination dials keyed together and to said driver element, as well as provided with mutually alignable edge seats and a stud engangeable with said seats and adapted for transmitting the movements of said driver element to said bolt element, said stud being movable from a released position to a working position whereat it is engaged with all of said seats, characterized in that said combination dials are defined by a ring broken by a cut and being clamped by elastic deformation onto a hub.

9. A lock according to claim 8, characterized in that said ring and hub have substantially smooth surfaces of mutual engagement.

10. A lock according to claim 8, characterized in that a means is provided for expanding said ring, defined by a key adapted for insertion into a notch formed in said ring and said cut, said notch and said key having substantially ellipsoidal shapes in a parallel plane to said ring.

11. A lock according to claim 8, characterized in that said ring is thinned on the side of said hub at least at said cut.

* * * * *